US009816250B2

(12) United States Patent
Maybury et al.

(10) Patent No.: US 9,816,250 B2
(45) Date of Patent: Nov. 14, 2017

(54) DIGGING AND BACKFILL APPARATUS

(71) Applicant: McLaughlin Group, Inc., Greenville, SC (US)

(72) Inventors: Charles Robert Maybury, Shippensburg, PA (US); John William Gilman, Greer, SC (US)

(73) Assignee: McLaughlin Group, Inc., Greenville, SC (US)

( * ) Notice: Subject to any disclaimer, the term of this patent is extended or adjusted under 35 U.S.C. 154(b) by 0 days.

(21) Appl. No.: 15/219,198

(22) Filed: Jul. 25, 2016

(65) Prior Publication Data

US 2017/0145656 A1 May 25, 2017

Related U.S. Application Data

(63) Continuation of application No. 14/200,532, filed on Mar. 7, 2014, now Pat. No. 9,399,853, which is a continuation of application No. 13/724,559, filed on Dec. 21, 2012, now Pat. No. 8,667,717, which is a continuation of application No. 13/175,510, filed on Jul. 1, 2011, now Pat. No. 8,336,231, which is a continuation of application No. 12/361,242, filed on (Continued)

(51) Int. Cl.

| | |
|---|---|
| ***E02F 3/88*** | (2006.01) |
| ***E02F 5/00*** | (2006.01) |
| ***E02F 5/22*** | (2006.01) |
| *E02F 3/92* | (2006.01) |

(52) U.S. Cl.

CPC ..... *E02F 5/003* (2013.01); *E02F 3/88* (2013.01); *E02F 3/8816* (2013.01); *E02F 3/8891* (2013.01); *E02F 5/223* (2013.01); *E02F 3/925* (2013.01)

(58) Field of Classification Search

CPC ..... E02F 3/88; E02F 3/8816; E02F 3/8821; E02F 3/925; E02F 5/003; E02F 5/223; E02D 3/08; E21B 7/18

USPC ..... 37/307, 309, 317–323, 347; 175/66, 67, 175/213, 424, 324; 405/88, 96; 406/157–162

See application file for complete search history.

(56) References Cited

U.S. PATENT DOCUMENTS 2,122,517 A * 7/1938 Curtis ..... B23Q 11/006 173/60

2,144,586 A * 1/1939 Kelley ..... E21B 21/07 16/35 R (Continued)

OTHER PUBLICATIONS

RockVac Brochure, dated: 1998.

(Continued)

*Primary Examiner* — Robert Pezzuto

(74) *Attorney, Agent, or Firm* — Nelson Mullins Riley & Scarborough LLP

(57) ABSTRACT

A mobile digging and backfill system for removing and collecting material above a buried utility. The system comprises a mobile chassis, a collection tank mounted to the chassis, a water pump mounted to the chassis for delivering a pressurized liquid flow against the material for loosening the material at a location, a vacuum pump connected to the collection tank so that an air stream created by the vacuum pump draws the material and the fluid from the location into the collection tank, and at least one backfill reservoir mounted to the chassis for carrying backfill for placement at the location.

2 Claims, 9 Drawing Sheets

Related U.S. Application Data

Jan. 28, 2009, now abandoned, which is a continuation of application No. 10/971,455, filed on Oct. 22, 2004, now Pat. No. 7,484,322.

(56) References Cited

U.S. PATENT DOCUMENTS

| | | | | |
|---|---|---|---|---|
| 2,250,670 | A | 7/1941 | Joy | |
| 2,448,546 | A | 9/1948 | Plemel et al. | |
| 2,480,692 | A | 8/1949 | Anthony | |
| 2,507,522 | A | 5/1950 | Heine | |
| 2,562,551 | A | 7/1951 | Henderson | |
| 2,639,601 | A | 5/1953 | Miller | |
| 3,540,618 | A | 11/1970 | Lildal | |
| 3,713,472 | A | 1/1973 | Dozois | |
| 3,768,203 | A | 10/1973 | Bellucci | |
| 3,888,528 | A | 6/1975 | Jericijo | |
| 3,968,845 | A | 7/1976 | Chaffin | |
| 4,119,238 | A | 10/1978 | Ali Ja'afar et al. | |
| 4,155,586 | A | 5/1979 | Flynn | |
| 4,307,541 | A | 12/1981 | Farmer et al. | |
| 4,322,868 | A | 4/1982 | Wurster | |
| 4,334,633 | A | 6/1982 | Piegza | |
| 4,434,861 | A | 3/1984 | Howeth | |
| 4,510,714 | A | 4/1985 | Kasper et al. | |
| 4,518,095 | A | 5/1985 | Engwert | |
| 4,655,362 | A | 4/1987 | Ecker et al. | |
| 4,669,628 | A | 6/1987 | Hatta | |
| 4,842,223 | A | 6/1989 | Allton et al. | |
| 4,936,031 | A * | 6/1990 | Briggs | E02F 3/925 37/189 |
| 5,016,717 | A | 5/1991 | Simons et al. | |
| 5,021,156 | A | 6/1991 | Sloan | |
| 5,092,963 | A | 3/1992 | Barker et al. | |
| 5,140,759 | A * | 8/1992 | Artzberger | E02F 3/88 137/874 |
| 5,141,528 | A | 8/1992 | Boczkiewicz et al. | |
| 5,191,993 | A | 3/1993 | Wanger et al. | |
| 5,287,602 | A | 2/1994 | Dykstra | |
| 5,295,317 | A | 3/1994 | Perrott | |
| 5,299,370 | A | 4/1994 | Gyori et al. | |
| 5,408,766 | A * | 4/1995 | Pobihushchy | E02F 3/905 37/323 |
| 5,500,976 | A | 3/1996 | Rohrbacher et al. | |
| 5,515,625 | A | 5/1996 | Keigley | |
| 5,791,073 | A | 8/1998 | Palmer et al. | |
| 5,860,232 | A | 1/1999 | Nathenson et al. | |
| 6,000,151 | A * | 12/1999 | Hayes | E02F 3/9206 175/67 |
| D423,521 | S | 4/2000 | Walter et al. | |
| 6,202,330 | B1 | 3/2001 | Bolton | |
| 6,273,512 | B1 | 8/2001 | Rajewski | |
| 6,360,458 | B2 | 3/2002 | Dolister | |
| 6,386,598 | B1 | 5/2002 | Dykstra et al. | |
| 6,397,967 | B1 | 6/2002 | McIlwraith | |
| 6,470,605 | B1 * | 10/2002 | Gilman | E02F 3/8816 37/323 |
| 6,499,934 | B1 | 12/2002 | Kaczmarski et al. | |
| 6,517,292 | B1 | 2/2003 | Landau | |
| 6,550,406 | B2 | 4/2003 | Bass et al. | |
| 6,604,304 | B1 | 8/2003 | Slabach et al. | |
| 6,615,849 | B1 * | 9/2003 | Gilman | E02F 3/8816 134/167 R |
| 6,988,568 | B2 | 1/2006 | Buckner | |
| 7,234,252 | B2 | 6/2007 | Jarnecke et al. | |
| 7,415,748 | B1 | 8/2008 | Guhr et al. | |
| 7,503,134 | B2 | 3/2009 | Buckner | |
| 7,523,570 | B2 * | 4/2009 | Pobihushchy | E02F 3/8816 175/67 |
| 7,644,523 | B2 | 1/2010 | Buckner | |
| 7,743,537 | B2 * | 6/2010 | Maybury, Jr. | E02F 3/8816 37/323 |
| 7,837,050 | B2 * | 11/2010 | Maybury, Jr. | E02F 3/8816 220/211 |
| 8,066,140 | B1 | 11/2011 | Young et al. | |
| 8,127,959 | B2 | 3/2012 | Gloor et al. | |
| 8,360,260 | B2 * | 1/2013 | Maybury, Jr. | E02F 3/8816 220/211 |
| 8,925,753 | B2 * | 1/2015 | Maybury, Jr. | E02F 3/8816 220/211 |
| 9,057,180 | B1 | 6/2015 | Sewell | |
| 9,260,048 | B2 | 2/2016 | Maybury, Jr. | |
| 9,260,049 | B2 | 2/2016 | Maybury, Jr. | |
| 9,260,050 | B2 | 2/2016 | Maybury, Jr. | |
| 2004/0108317 | A1 | 6/2004 | Buckner | |
| 2005/0210623 | A1 | 9/2005 | Buckner | |
| 2006/0032095 | A1 | 2/2006 | Buckner | |
| 2006/0086010 | A1 | 4/2006 | Jarnecke et al. | |
| 2006/0118338 | A1 | 6/2006 | Maybury, Jr. | |
| 2006/0182591 | A1 | 8/2006 | Hackett et al. | |
| 2007/0261309 | A1 | 11/2007 | Tommell et al. | |
| 2008/0066383 | A1 | 3/2008 | Decker et al. | |
| 2008/0083143 | A1 | 4/2008 | Maybury | |
| 2008/0085163 | A1 | 4/2008 | Maybury | |
| 2008/0244859 | A1 | 10/2008 | Maybury | |
| 2010/0320204 | A1 | 12/2010 | Maybury, Jr. | |
| 2011/0088289 | A1 | 4/2011 | Maybury, Jr. | |
| 2011/0107548 | A1 | 5/2011 | Maybury, Jr. | |
| 2012/0317882 | A1 | 12/2012 | Zazula | |
| 2013/0062893 | A1 | 3/2013 | McLaughlin et al. | |
| 2013/0134163 | A1 | 5/2013 | Maybury, Jr. | |
| 2014/0230937 | A1 | 8/2014 | Maybury, Jr. | |
| 2014/0230938 | A1 | 8/2014 | Maybury, Jr. | |
| 2014/0239624 | A1 | 8/2014 | Maybury, Jr. | |

OTHER PUBLICATIONS

SerVac Brochure, No date.

Office Action dated May 11, 2010, from corresponding U.S. Appl. No. 11/544,428.

Response to Office Action dated May 11, 2010, from corresponding U.S. Appl. No. 11/544,428.

Office Action dated Sep. 24, 2010, from corresponding U.S. Appl. No. 12/855,478 (now abandoned).

Office Action dated Jun. 27, 2013, from corresponding U.S. Appl. No. 13/751,987.

Response to Office Action dated Jun. 27, 2013, from corresponding U.S. Appl. No. 13/751,987.

Final Office Action dated Oct. 1, 2013, from corresponding U.S. Appl. No. 13/751,987.

Response to Final Office Action dated Oct. 1, 2013, from corresponding U.S. Appl. No. 13/751,987.

Office Action dated Mar. 3, 2015, for corresponding U.S. Appl. No. 14/266,159.

Response to Office Action dated Mar. 3, 2015, for corresponding U.S. Appl. No. 14/266,159.

Office Action dated Mar. 4, 2015, for corresponding U.S. Appl. No. 14/266,354.

Response to Office Action dated Mar. 4, 2015, for corresponding U.S. Appl. No. 14/266,354.

Office Action dated Mar. 6, 2015, for corresponding U.S. Appl. No. 14/266,439.

Response to Office Action dated Mar. 6, 2015, for corresponding U.S. Appl. No. 14/266,439.

Reimann & Georger Corp.—Website Brochure for Hydra Core Drill dated Jan. 25, 2005.

* cited by examiner

DIGGING AND BACKFILL APPARATUS

CLAIM OF PRIORITY

This application is a continuation of U.S. patent application Ser. No. 14/200,532, filed Mar. 7, 2014, now U.S. Pat. No. 9,399,853, which is a continuation of U.S. patent application Ser. No. 13/724,559, filed Dec. 21, 2012, now U.S. Pat. No. 8,667,717, which is a continuation of U.S. patent application Ser. No. 13/175,510, filed Jul. 1, 2011, now U.S. Pat. No. 8,336,231, which is a continuation of U.S. patent application Ser. No. 12/361,242, filed Jan. 28, 2009 (abandoned), which is a continuation of U.S. patent application Ser. No. 10/971,455, filed Oct. 22, 2004, now U.S. Pat. No. 7,484,322, the entire disclosures which are incorporated by reference herein.

FIELD OF THE INVENTION

This invention relates generally to a reduction system for removing soil to expose underground utilities (such as electrical and cable services, water and sewage services, etc.), and more particularly to a system for removing materials from the ground and backfilling the area.

BACKGROUND OF THE INVENTION

With the increased use of underground utilities, it has become more critical to locate and verify the placement of buried utilities before installation of additional underground utilities or before other excavation or digging work is performed. Conventional digging and excavation methods such as shovels, post hole diggers, powered excavators, and backhoes may be limited in their use in locating buried utilities as they may tend to cut, break, or otherwise damage the lines during use.

Devices have been previously developed to create holes in the ground to non-destructively expose underground utilities to view. One design uses high pressure air delivered through a tool to loosen soil and a vacuum system to vacuum away the dirt after it is loosened to form a hole. Another system uses high pressure water delivered by a tool to soften the soil and create a soil/water slurry mixture. The tool is provided with a vacuum system for vacuuming the slurry away.

SUMMARY OF THE INVENTION

The present invention recognizes and addresses disadvantages of prior art constructions and methods, and it is an object of the present invention to provide an improved drilling and backfill system. This and other objects may be achieved by a mobile digging and backfill system for removing and collecting material above a buried utility. The system comprises a mobile chassis, a collection tank mounted to the chassis, a water pump mounted to the chassis for delivering a pressurized liquid flow against the material for loosening the material at a location, a vacuum pump connected to the collection tank so that an air stream created by the vacuum pump draws the material and the fluid from the location into the collection tank, and at least one backfill reservoir mounted to the chassis for carrying backfill for placement at the location.

In another embodiment, a mobile digging and backfill system for removing and collecting material comprises a mobile digging and backfill system for removing and collecting material. The system has a mobile chassis, a collection tank moveably mounted to the chassis, and a digging tool comprising at least one nozzle and a vacuum passage proximate the nozzle. A water pump mounted on the chassis has an output connected to the nozzle for delivering a pressurized liquid flow against the material for loosening the material at a location. A vacuum pump mounted on the chassis has an input connected to the collection tank so that an air stream created by the vacuum pump draws the material and the fluid from the location into the collection tank. A motor mounted to the chassis and is in driving engagement with the water pump and said vacuum pump. A first backfill reservoir is moveably mounted on the chassis for carrying backfill for placement at the location.

BRIEF DESCRIPTION OF THE DRAWINGS

A full and enabling disclosure of the present invention, including the best mode thereof directed to one of ordinary skill in the art, is set forth in the specification, which makes reference to the appended figures, in which.

Figure 1:
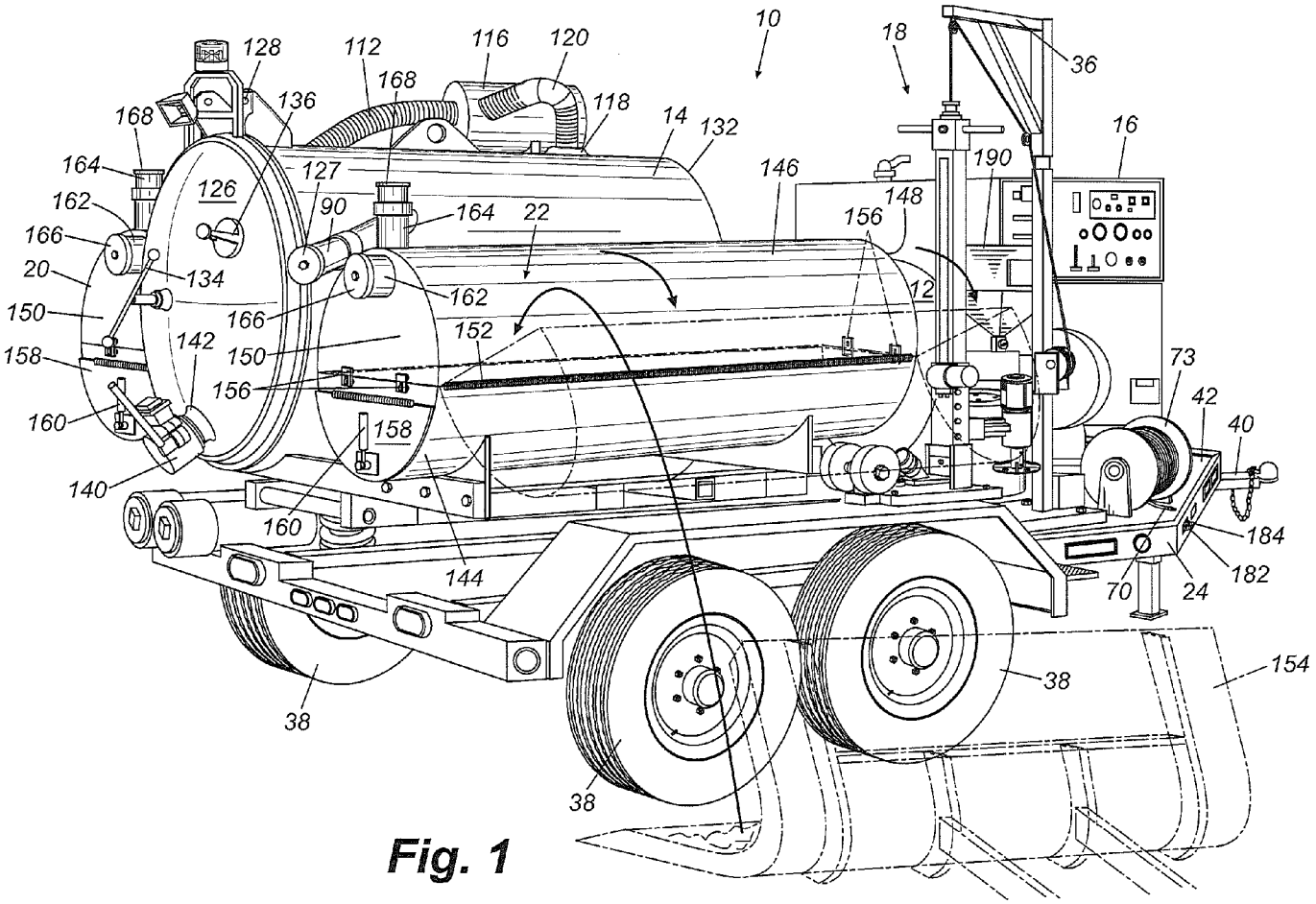
FIG. 1 is a perspective view of a drilling and backfill system constructed in accordance with one embodiment of the present invention.

Repeat use of reference characters in the present specification and drawings is intended to represent same or analogous features or elements of the invention.

DETAILED DESCRIPTION

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

Referring to FIG. 1, a drilling and backfill system 10 generally includes a water reservoir tank 12, a collection tank 14, a motor 16, a drilling apparatus 18, and back fill reservoirs 20 and 22, all mounted on a mobile chassis 24, which is, in this embodiment, in the form of a trailer. Trailer 24 includes four wheels 38 (only three of which are shown in FIG. 1) and a draw bar and hitch 40. Drilling and backfill system 10 generally mounts on a platform 42, which is part of trailer 24. It should be understood that while drill and backfill system 10 is illustrated mounted on a trailer having a platform, the system may also be mounted on the chassis of a vehicle such as a truck or car. Further, a chassis may comprise any frame, platform or bed to which the system components may be mounted and that can be moved by a motorized vehicle such as a car, truck, or skid steer. It should be understood that the components of the system may be either directly mounted to the chassis or indirectly mounted to the chassis through connections with other system components.

Figure 10:
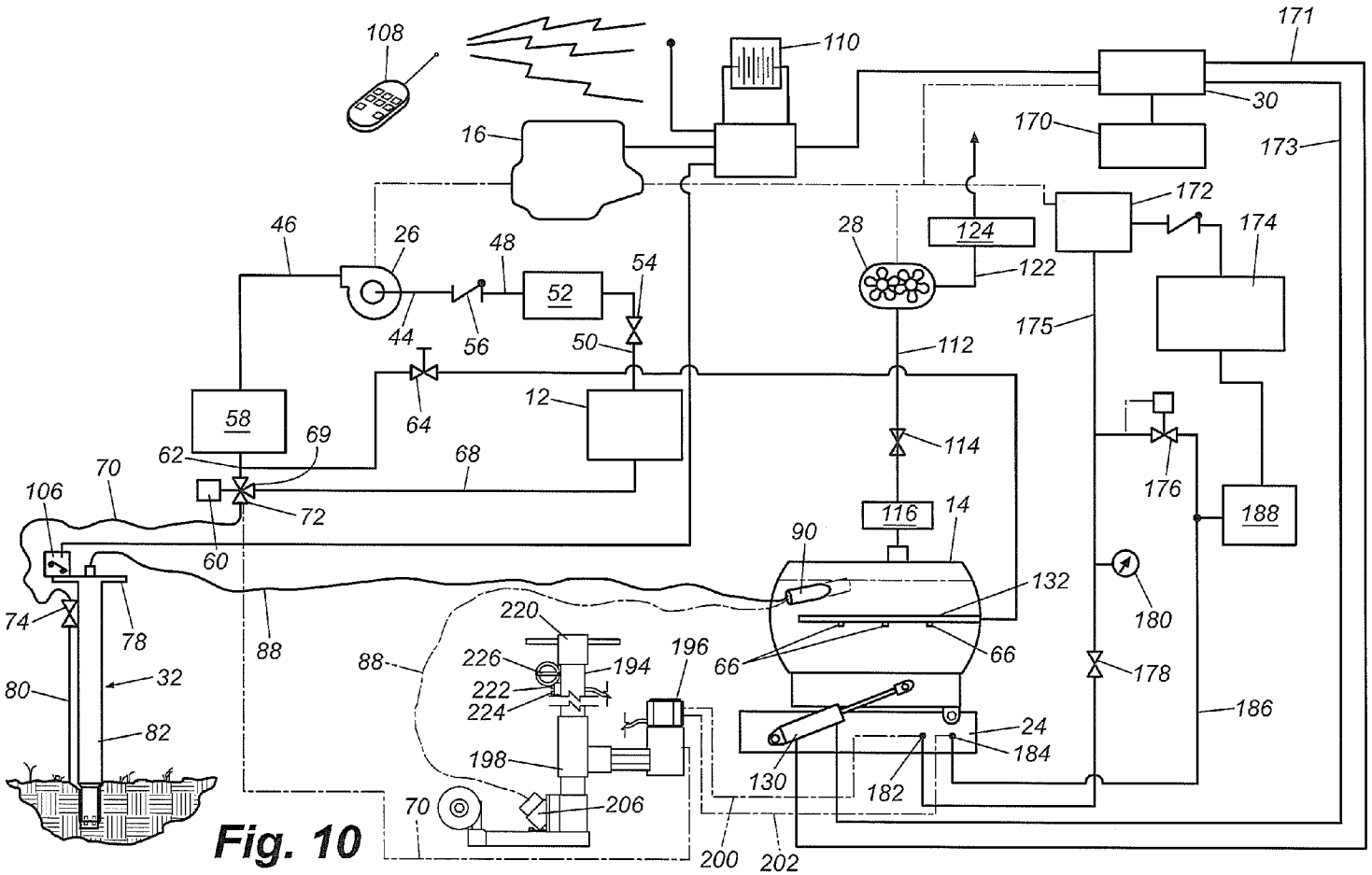
FIG. 10 is a schematic view of the hydraulic, electric, water, and vacuum systems of the drilling and backfill system of FIG. 1.

The connection of the various components of system 10 is best illustrated in FIG. 10. Motor 16 is mounted on a forward end of trailer 24 and provides electricity to power two electric hydraulic pumps 30 and 172, and it also drives both a water pump 26 and a vacuum pump 28 by belts (not shown). Motor 16 is preferably a gas or diesel engine, although it should be understood that an electric motor or other motive means could also be used. In one preferred embodiment, motor 16 is a thirty horsepower diesel engine, such as Model No. V1505 manufactured by Kubota Engine division of Japan, or a twenty-five horsepower gasoline engine such as Model Command PRO CH25S manufactured by Kohler Engines. The speed of motor 16 may be varied between high and low by a wireless keypad transmitter 108 that transmits motor speed control to a receiver 110 connected to the throttle of motor 16.

The water system will now be described with reference to FIG. 10. Water reservoir tank 12 connects to water pump 26, which includes a low pressure inlet 44 and a high pressure outlet 46. In the illustrated embodiment, water pump 26 can be any of a variety of suitable pumps that delivers between 3,000 and 4,000 lbs/in$^2$ at a flow rate of approximately five gallons per minute. In one preferred embodiment, water pump 26 is a Model No. TS2021 pump manufactured by General Pump. Water tank 12 includes an outlet 50 that connects to a strainer 52 through a valve 54. The output of strainer 52 connects to the low pressure side of water pump 26 via a hose 48. A check valve 56 is placed inline intermediate strainer 52 and low pressure inlet 44. High pressure outlet 46 connects to a filter 58 and then to a pressure relief and bypass valve 60. In one preferred embodiment, pressure relief and bypass valve 60 is a Model YUZ140 valve manufactured by General Pump.

Figure 3:
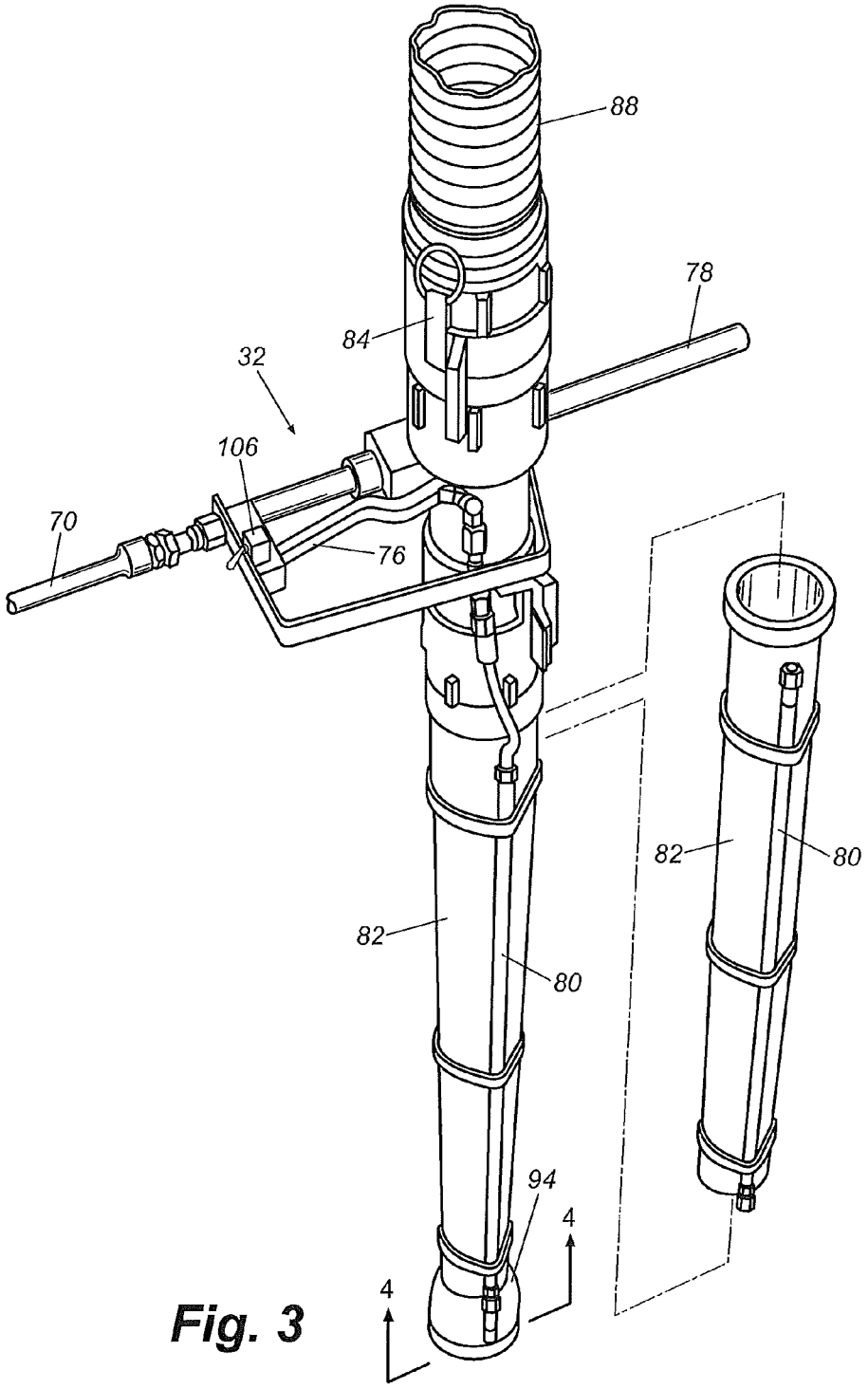
FIG. 3 is a perspective view of a reduction tool for use with the drilling and backfill system of FIG. 1.

A "T" 62 and a valve 64, located intermediate valve 60 and filter 58, connect the high pressure output 46 to a plurality of clean out nozzles 66 mounted in collection tank 14 to clean the tank's interior. A return line 68 connects a low pressure port 69 of valve 60 to water tank 12. When a predetermined water pressure is exceeded in valve 60, water is diverted through low port 69 and line 68 to tank 12. A hose 70, stored on a hose reel 73 (FIG. 1), connects an output port 72 of valve 60 to a valve 74 on a digging tool 32 (FIG. 3). A valve control 76 (FIG. 3) at a handle 78 of digging tool 32 provides the operator with a means to selectively actuate valve 74 on digging tool 32. The valve delivers a high pressure stream of water through a conduit 80 (FIGS. 3, 5, 7, and 10) attached to the exterior of an elongated pipe 82 that extends the length of digging tool 32.

Figure 7:
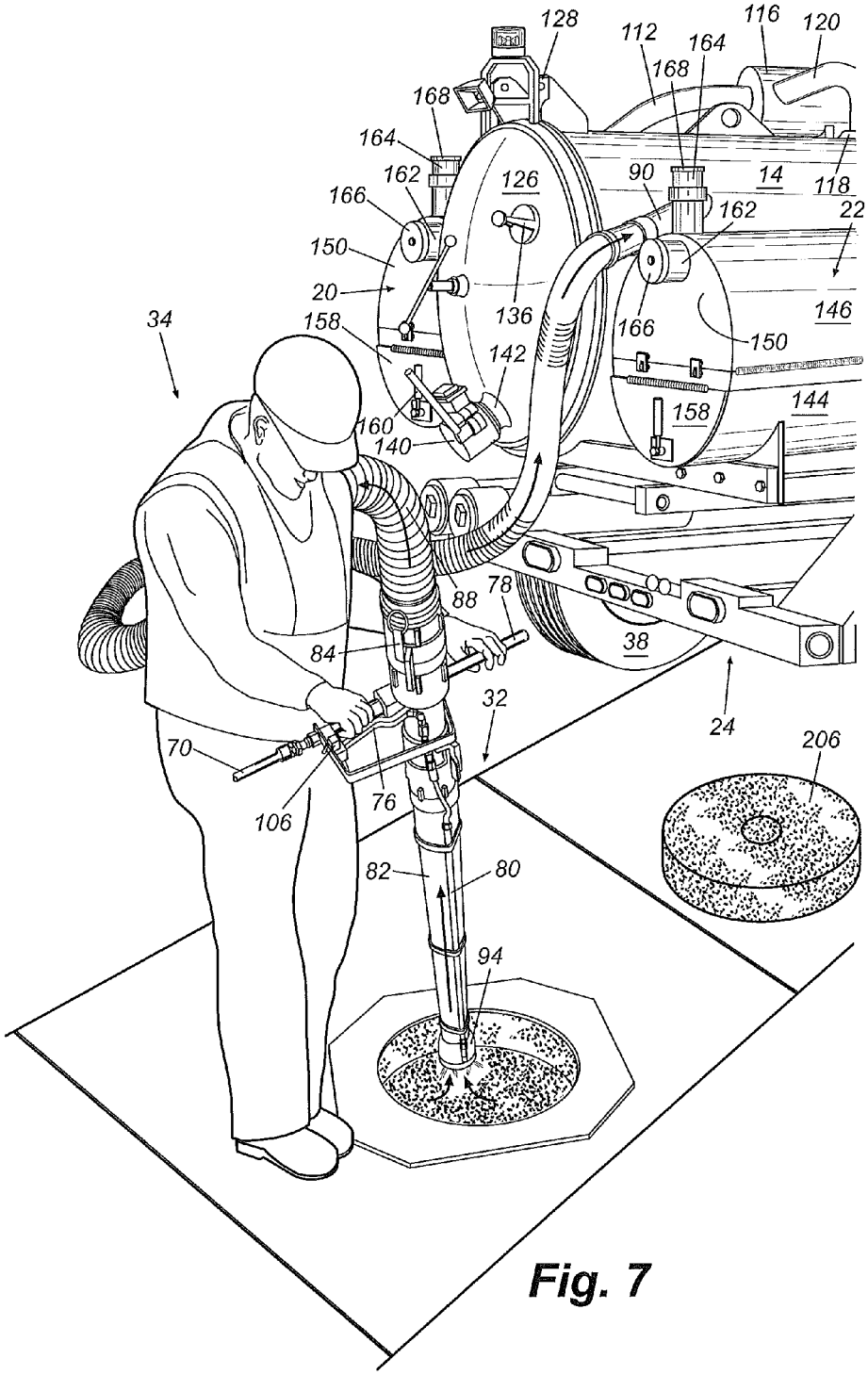
FIG. 7 is a perspective view of the reduction tool of FIG. 3 in use digging the hole.

Referring to FIG. 3, digging tool 32 includes handle 78 for an operator 34 (FIG. 7) to grasp during use of the tool. A connector 84, such as a "banjo" type connector, connects the vacuum system on drilling and back fill system 10 (FIG. 1) to a central vacuum passage 86 (FIG. 4) in digging tool 32. Connector 84 is located proximate handle 78. Vacuum passage 86 extends the length of elongated pipe 82 and opens to one end of a vacuum hose 88. The other end of hose 88 connects to an inlet port 90 on collection tank 14 (FIG. 7). It should be understood that other types of connectors may be used in place of "banjo" connector 84, for example clamps, clips, or threaded ends on hose 88 and handle 78.

Figure 4:
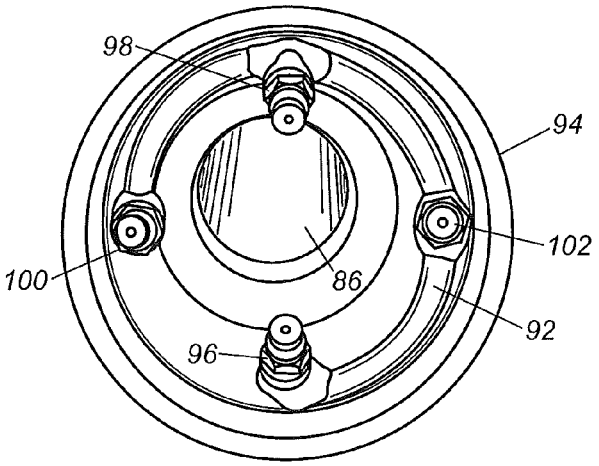
FIG. 4 is bottom view of the reduction tool shown in FIG. 3.
Figure 5:
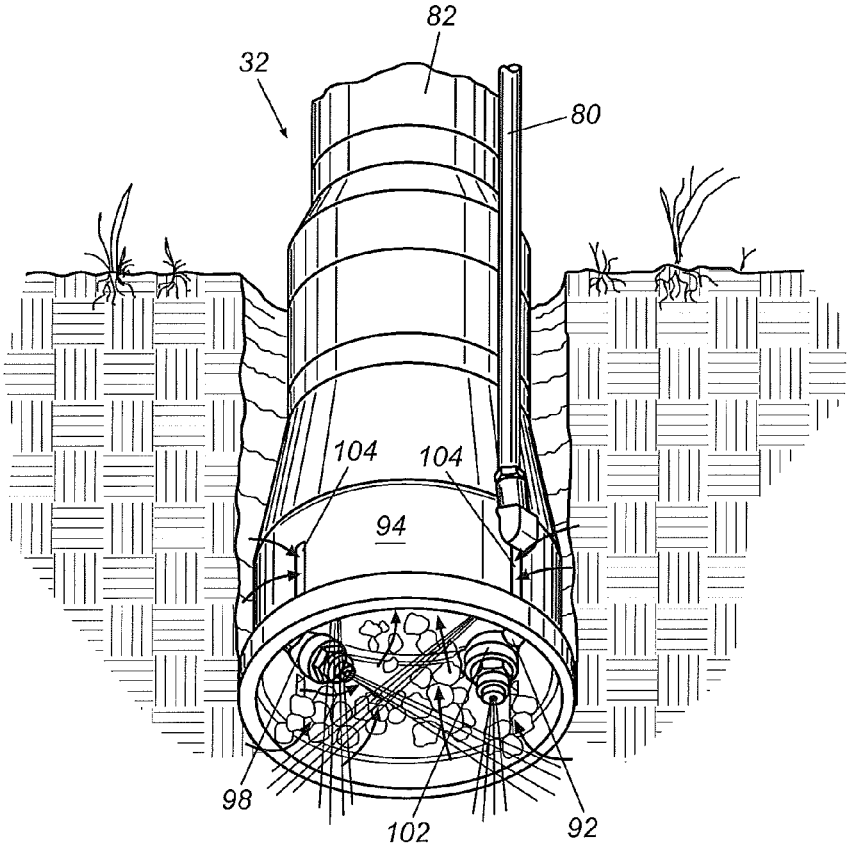
FIG. 5 is a partial perspective view of the reduction tool of FIG. 3 in use digging a hole.

Referring to FIGS. 4 and 5, a fluid manifold 92, located at a distal end 94 of digging tool 32, connects to water conduit 80 and contains a plurality of nozzles that are angled with respect to one another. In one preferred embodiment having four nozzles, two nozzles 96 and 98 are directed radially inwardly at approximately 45 degrees from a vertical axis of the digging tool, and the two remaining nozzles 100 and 102 are directed parallel to the axis of the digging tool. During use of the drilling tool, nozzles 96 and 98 produce a spiral cutting action that breaks the soil up sufficiently to minimize clogging of large chunks of soil within vacuum passage 86 and/or vacuum hose 88. Vertically downward pointing nozzles 100 and 102 enhance the cutting action of the drilling tool by allowing for soil to be removed not only above a buried utility, but in certain cases from around the entire periphery of the utility. In other words, the soil is removed above the utility, from around the sides of the utility, and from beneath the utility. This can be useful for further verifying the precise utility needing service and, if necessary, making repairs to or tying into the utility.

Digging tool 32 also contains a plurality of air inlets 104 formed in pipe distal end 94 that allow air to enter into vacuum passage 86. The additional air, in combination with the angled placement of nozzles 96 and 98, enhances the cutting and suction provided by tool 32. Returning to FIG. 6, digging tool 32 may also include a control 106 for controlling the tool's vacuum feature. Control 106 may be an electrical switch, a vacuum or pneumatic switch, a wireless switch, or any other suitable control to adjust the vacuum action by allowing the vacuum to be shut off or otherwise modulated. An antifreeze system, generally 190 (FIGS. 1 and 2), may be provided to prevent freezing of the water pump and the water system. Thus, when the pump is to be left unused in cold weather, water pump 26 may draw antifreeze from the antifreeze reservoir through the components of the water system to prevent water in the hoses from freezing and damaging the system.

Turning now to FIGS. 7 and 10, vacuum pump 28 is preferably a positive displacement type vacuum pump such as that used as a supercharger on diesel truck. In one preferred embodiment, vacuum pump 28 is a Model 4009-46R3 blower manufactured by Tuthill. A hose 112 connects an intake of the vacuum pump to a vacuum relief device 114, which may be any suitable vacuum valve, such as a Model 215V-H01AQE spring loaded valve manufactured by Kunkle. Vacuum relief device 114 controls the maximum negative pressure of the vacuum pulled by pump 28, which is in the range of between 10 and 15 inches of Hg in the illustrated embodiment. A filter 116, located up stream of pressure relief valve 114, filters the vacuum air stream before it passes through vacuum pump 28. In one preferred embodiment, the filter media may be a paper filter such as those manufactured by Fleet Guard. Filter 116 connects to an exhaust outlet 118 of collection tank 14 by a hose 120, as shown in FIGS. 1, 7, 8, and 9. An exhaust side 122 of vacuum pump 28 connects to a silencer 124, such as a Model TS30TR silencer manufactured by Cowl. The output of silencer 124 exits into the atmosphere.

The vacuum air stream pulled through vacuum pump 28 produces a vacuum in collection tank 14 that draws a vacuum air stream through collection tank inlet 90. When inlet 90 is not closed off by a plug 127 (FIG. 1), the inlet may be connected to hose 88 leading to digging tool 32. Thus, the vacuum air stream at inlet 90 is ultimately pulled through vacuum passage 86 at distal end 94 of tool 32. Because it is undesirable to draw dirt or other particulate matter through the vacuum pump, a baffle system, for example as described in U.S. Pat. No. 6,470,605 (the entire disclosure which is incorporated herein), is provided within collection tank 14 to separate the slurry mixture from the vacuum air stream. Consequently, dirt, rocks, and other debris in the air flow hit a baffle (not shown) and fall to the bottom portion of the collection tank. The vacuum air stream, after contacting the baffle, continues upwardly and exits through outlet 118 through filter 116 and on to vacuum pump 28.

Figure 8:
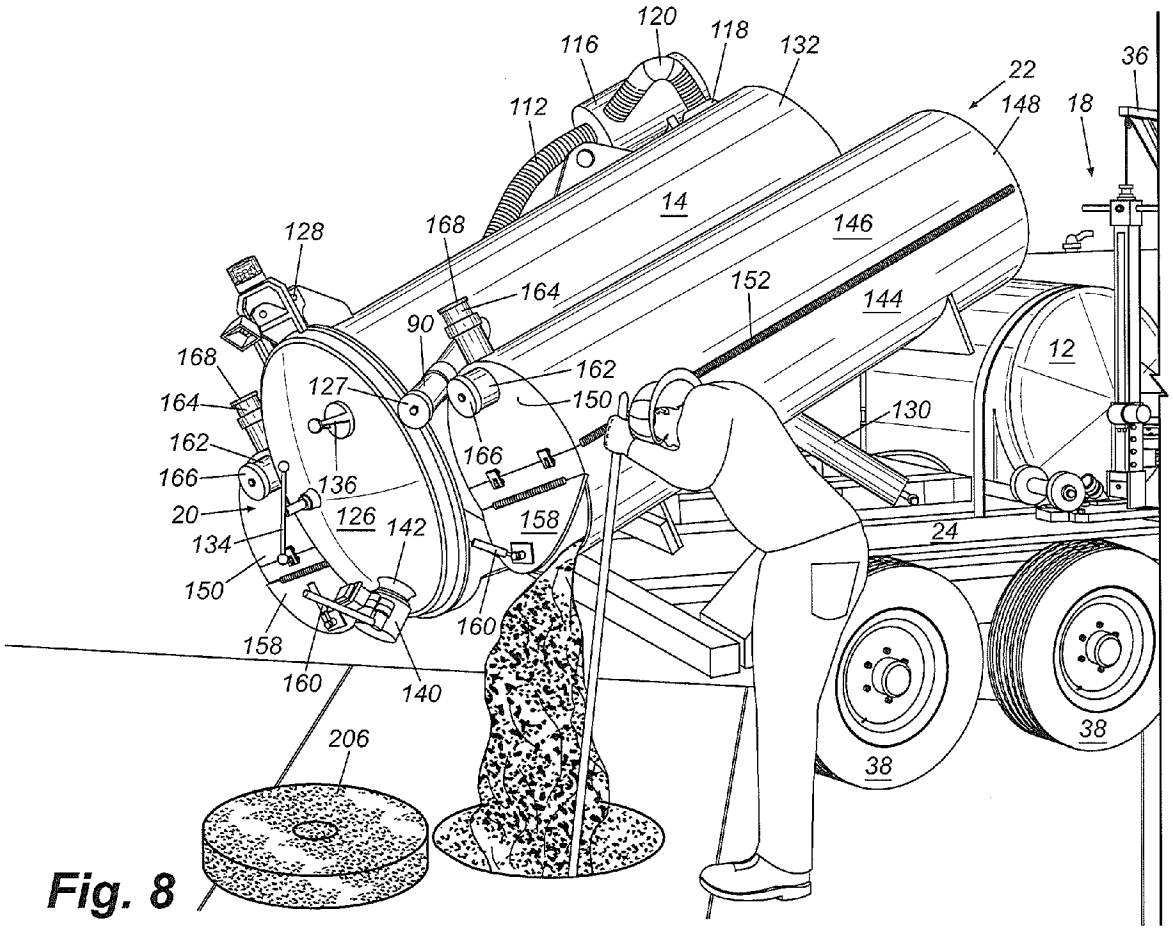
FIG. 8 is a perspective view of the drilling and backfill system of FIG. 1, showing the hole being backfilled.

Referring once again to FIG. 1, collection tank 14 includes a discharge door 126 connected to the main tank body by a hinge 128 that allows the door to swing open, thereby providing access to the tank's interior for cleaning. A pair of hydraulic cylinders 130 (only one of which is shown in FIG. 8) are provided for tilting a forward end 132 of tank 14 upwards in order to cause the contents to run towards discharge door 126. A gate valve 140, coupled to a drain 142 in discharge door 126, drains the liquid portion of the slurry in tank 14 without requiring the door to be opened. Gate valve 140 may also be used to introduce air into collection tank 14 to reduce the vacuum in the tank so that the door may be opened.

Running the length of the interior of collection tank 14 is a nozzle tube 132 (FIG. 10) that includes nozzles 66 for directing high pressure water about the tank, and particularly towards the base of the tank. Nozzles 66 are actuated by opening valve 64 (FIG. 10), which delivers high pressure water from pump 26 to nozzles 66 for producing a vigorous cleaning action in the tank. When nozzles 66 are not being used for cleaning, a small amount of water is allowed to continuously drip through the nozzles to pressurize them so as to prevent dirt and slurry from entering and clogging the nozzles.

Nozzle tube 132, apart from being a conduit for delivering water, is also a structural member that includes a threaded male portion (not shown) on an end thereof adjacent discharge door 126. When discharge door 126 is shut, a screw-down type handle 134 mounted in the door is turned causing a threaded female portion (not shown) on tube 132 to mate with the male portion. This configuration causes the door to be pulled tightly against an open rim (not shown) of the collection tank. Actuation of vacuum pump 28 further assists the sealing of the door against the tank opening. Discharge door 126 includes a sight glass 136 to allow the user to visually inspect the tank's interior.

Backfill reservoirs 20 and 22 are mounted on opposite sides of collection tank 14. The back fill reservoirs are mirror images of each other; therefore, for purposes of the following discussion, reference will only be made to backfill reservoir 22. It should be understood that backfill reservoir 20 operates identically to that of reservoir 22. Consequently, similar components on backfill reservoir 20 are labeled with the same reference numerals as those on reservoir 22.

Referring to FIG. 1, back fill reservoir 22 is generally cylindrical in shape and has a bottom portion 144, a top portion 146, a back wall 148, and a front wall 150. Top portion 146 connects to bottom portion 144 by a hinge 152. Hinge 152 allows backfill reservoir 22 to be opened and loaded with dirt by a front loader 154, as shown in phantom in FIG. 1. Top portion 146 secures to bottom portion 144 by a plurality of locking mechanisms 156 located on the front and back walls. Locking mechanisms 156 may be clasps, latches or other suitable devices that secure the top portion to the bottom portion. The seam between the top and bottom portion does not necessarily need to be a vacuum tight seal, but the seal should prevent backfill and large amounts of air from leaking from or into the reservoir. Front wall 150 has a hinged door 158 that is secured close by a latch 160. As illustrated in FIG. 8, hydraulic cylinders 130 enable the back fill reservoirs to tilt so that dirt can be off loaded through doors 158.

As previously described above, backfill reservoirs 20 and 22 may be filled by opening top portions 146 of the reservoirs and depositing dirt into bottom portion 144 with a front loader. Vacuum pump 28, however, may also load dirt into back fill reservoirs 20 and 22. In particular, back fill reservoir 22 has an inlet port 162 and an outlet port 164. During normal operation, plugs 166 and 168 fit on respective ports 162 and 164 to prevent backfill from leaking from the reservoir. However, these plugs may be removed, and outlet port 164 may be connected to inlet port 90 on collection tank 14 by a hose (not shown), while hose 88 may be attached to inlet port 162. In this configuration, vacuum pump 28 pulls a vacuum air stream through collection tank 14, as described above, through the hose connecting inlet port 90 to outlet port 164, and through hose 88 connected to inlet port 162. Thus, backfill dirt and rocks can be vacuumed into reservoirs 20 and 22 without the aide of loader 154. It should be understood that this configuration is beneficial when backfill system 10 is being used in an area where no loader is available to fill the reservoirs. Once the reservoirs are filled, the hoses are removed from the ports, and plugs 166 and 168 are reinstalled on respective ports 162 and 164.

Referring once more to FIG. 10, hydraulic cylinders 130, used to tilt collection tank 14 and backfill reservoirs 20 and 22, are powered by electric hydraulic pump 30. Hydraulic pump 30 connects to a hydraulic reservoir 170 and is driven by the electrical system of motor 16. A high pressure output line 171 and a return line 173 connect pump 30 to hydraulic cylinders 130. Hydraulic pump 172, mounted on trailer 24, is separately driven by motor 16 and includes its own hydraulic reservoir 174. An output high pressure line 175 and a return line 186 connect pump 172 to a pair of quick disconnect couplings 182 and 184, respectively. That is, high pressure line 175 connects to quick disconnect coupling 182 (FIGS. 1 and 2) through a control valve 178, and return line 186 connects quick disconnect coupling 184 to reservoir 188. A pressure relief valve 176 connects high pressure line 175 to reservoir 188 and allows fluid to bleed off of the high pressure line if the pressure exceeds a predetermined level. A pressure gauge 180 may also be located between pump 172 and control valve 178.

Quick disconnect coupling 182 provides a high pressure source of hydraulic fluid for powering auxiliary tools, such as drilling apparatus 18, tamper device 185, or other devices that may be used in connection with drilling and backfill system 10. The high pressure line preferably delivers between 5.8 and 6 gallons per minute of hydraulic fluid at a pressure of 2000 lbs/in$^2$. Hydraulic return line 186 connects to a quick disconnect coupling 184 (FIGS. 1 and 2) on trailer 24. Intermediate quick disconnect coupling 184 and hydraulic fluid reservoir 174 is a filter 188 that filters the hydraulic fluid before returning it to hydraulic reservoir 174. While quick disconnect couplings 182 and 184 are shown on the side of trailer 24, it should be understood that the couplings may also be mounted on the rear of trailer 24.

Figure 2:
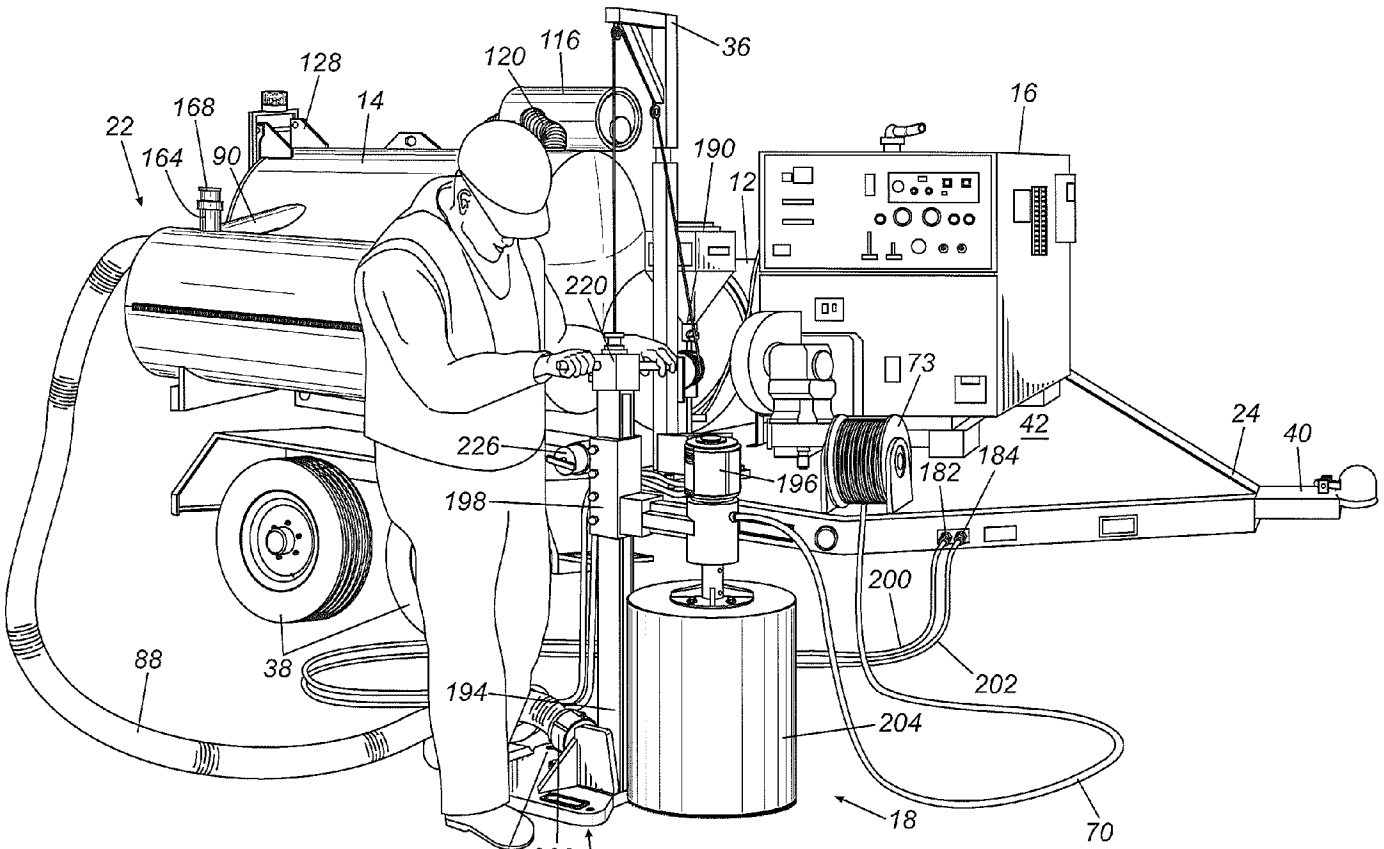
FIG. 2 is a perspective view of a key hole drill for use with the drilling and backfill system of FIG. 1.

Referring to FIGS. 1 and 2, drilling apparatus 18 is carried on trailer 24 and is positioned using winch and crane 36. Drilling apparatus 18 includes a base 192, a vertical body 194, and a hydraulic drill motor 196 slidably coupled to vertical body 194 by a bracket 198. A high pressure hose 200 and a return hose 202 power motor 196. A saw blade 204 attaches to an output shaft of hydraulic motor 196 and is used to drill a coupon 206 (FIG. 7) in pavement, concrete or other hard surfaces to expose the ground above the buried utility. The term coupon as used herein refers to a shaped material cut from a continuous surface to expose the ground beneath the material. For example, as illustrated in FIG. 7, coupon 206 is a circular piece of concrete that is cut out of a sidewalk to expose the ground thereunder.

Body 194 has a handle 220 for the user to grab and hold onto during the drilling process. Hydraulic fluid hoses 200 and 202 connect to two connectors 222 and 224 (FIG. 10) mounted on body 194 and provide hydraulic fluid to hydraulic drill motor 196. A crank 226 is used to move the drill motor vertically along body 194. Drilling apparatus 18 is a Model CD616 Hydra Core Drill manufactured by Reimann & Georger of Buffalo, N.Y. and is referred to herein as a "core drill."

In prior art systems, base 192 was secured to pavement or concrete using lag bolts, screws, spikes, etc. These attachment methods caused unnecessary damage to the surrounding area and required additional repair after the utility was fixed and the hole was backfilled. Additionally, having to drill additional holes for the bolts or screws or pounding of the spikes with a sledge hammer presented unnecessary additional work. Thus, the drilling apparatus of the present invention uses the vacuum system of drilling and backfill system 10 to secure base 192 to the pavement.

Figure 6:
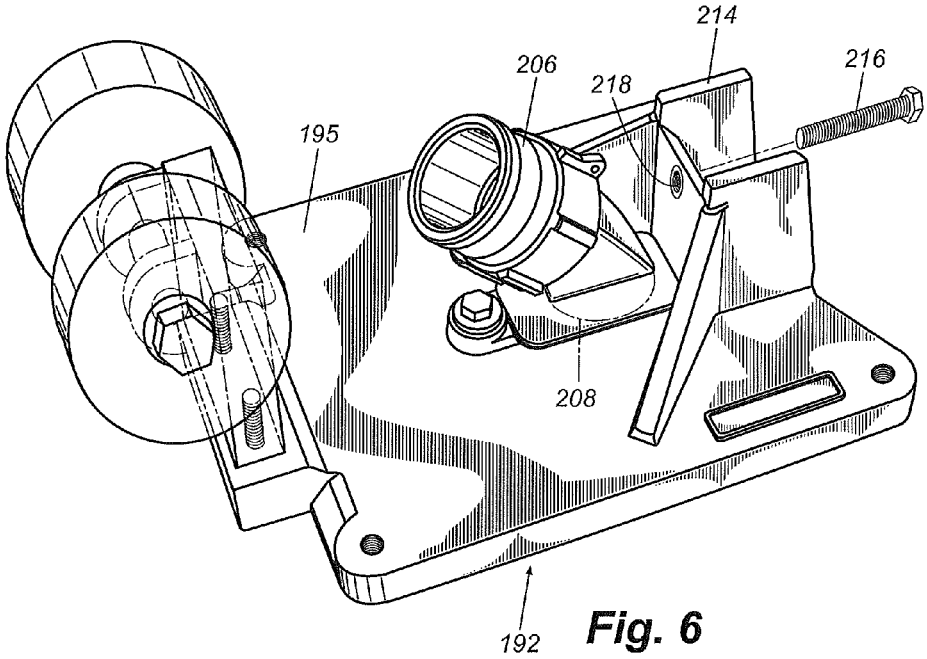
FIG. 6 is a perspective view of a key hole drilling tool base for use with the key hole drill of FIG. 2.
Figure 6A:
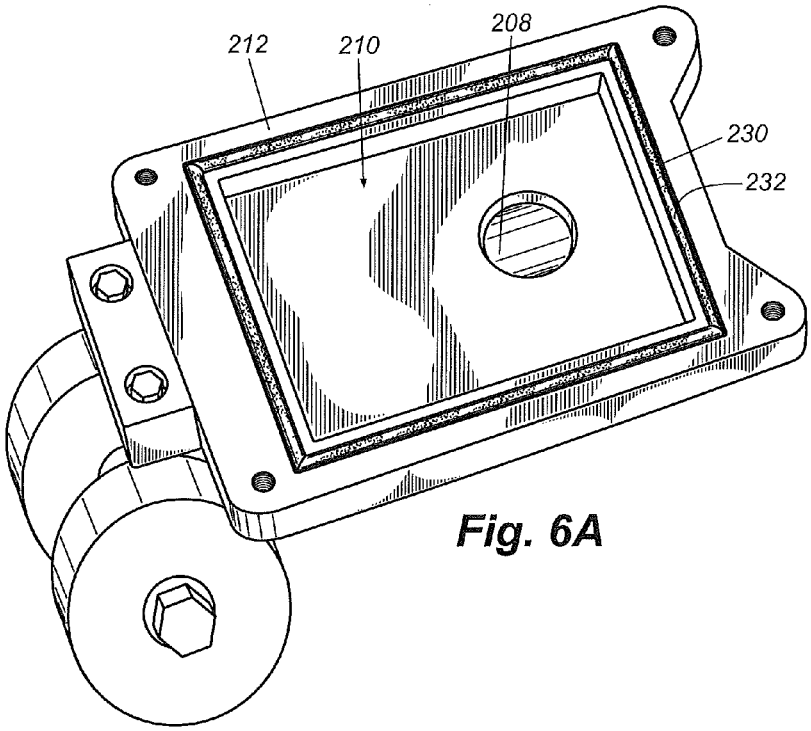
FIG. 6A is a bottom perspective view of the tool base shown in FIG. 6.

Referring to FIGS. 6 and 6A, base 192 includes a flat plate 195 having a connector 206 attached to a top surface thereof. Connector 206 attaches to an outlet port 208 formed in a top surface of plate 195 that is in fluid communication with a recessed chamber 210 (FIG. 6A) formed in a bottom surface 212 of plate 195. That is, outlet port 208 has a passageway therethrough that extends between the top and bottom surfaces. A groove 230 formed in bottom surface 212 receives a pliable gasket 232 that forms a relatively air tight seal between the bottom surface 212 and the pavement or concrete being drilled. It should be understood that while a gasket is shown, it may not be necessary depending on the strength of the vacuum air stream being pulled through connector 206 since bottom surface 212 can form a sufficient seal with the pavement or concrete. A bracket 214 coupled to a top surface of plate 195 fixedly secures body 194 (FIG. 2) to base 192. A bolt or screw 216 is received through body 194 and into a threaded bore 218 to secure the body to the base. Wheels attached to the base allow the drilling apparatus to be moved around the work area after it has been off loaded the trailer by winch and crane 36. The term "base" as used herein refers to a drill support structure that maintains a secure connection of the drill to a surface proximate the area to be drilled. The drill base should have a generally planar bottom surface, and the remaining structure of the base may be of any suitable shape to secure the drill motor to the base.

Referring to FIG. 2, hose 88 connects to connector 206 by a suitable clamp (not shown). Once core drill 18 is positioned, vacuum pump 26 is turned on and a vacuum is pulled through hose 88 into chamber 210, providing a vacuum of between 12-15 inches of Hg, which is sufficient to fixedly secure base 192 to the pavement or concrete during the drilling process. Prior to moving core drill 18, vacuum pump 28 is shut down to eliminate the vacuum produced in chamber 210.

The operation of the drilling and backfill system will now be described with reference to FIGS. 2, 7 to 9 and 10. Prior to using drilling and backfill system 10, water is added to water tank 12, and valve 54 is opened to allow water to flow to water pump 26. Motor 16 is powered up, and water pressure is allowed to build in the system.

Referring to FIG. 2, if a utility is located under concrete, core drill 18 is positioned over the utility, and vacuum hose 88 is connected from inlet port 90 on collection tank 14 to connector 206 on base plate 195. Hydraulic hoses 200 and 202 are connected to hydraulic motor 196 at connectors 222 and 224, and vacuum pump 28 and hydraulic pump 172 are powered up. Saw 204 is used to cut coupon 206 (FIG. 7) from the concrete to expose the ground over the utility. Hose 70 connects to saw 204 and provides a steady stream of water that flushes the drill bit during the drilling process. Coupon 206 is removed from the hole and placed aside so that it can be reused in repairing the hole after it is backfilled.

Next, and referring to FIG. 7, the user disconnects vacuum hose 88 from connector 206 and connects the hose to digging tool handle 78 using banjo connector 84. High pressure water hose 70 is also connected to valve 74 to provide water to the digging tool. As tool 32 is used, it is pressed downwardly into the ground to dig a hole. For larger diameter holes, digging tool 32 is moved in a generally circular manner as it is pressed downward. Slurry formed in the hole is vacuumed by tool 32 through vacuum passage 86 (FIGS. 4 and 5) and accumulates in collection tank 26. Once the hole is completed and the utility exposed, the vacuum system can be shut down, and the operators may examine or repair the utility as needed.

After work on the utility is completed, and referring to FIG. 8, the operator may cover the utility with clean backfill from backfill reservoirs 20 and 22. In particular, trailer 24 is positioned so that one of backfill reservoirs 20 or 22 is proximate the hole. Hydraulic cylinders 130 are activated, causing the tanks to tip rearward so that backfill can be delivered through door 158 into the hole. Once the hole is sufficiently filled, hydraulic cylinders 130 return reservoirs 20 and 22 to their horizontal position, and door 158 is secured in the closed position.

Figure 9:
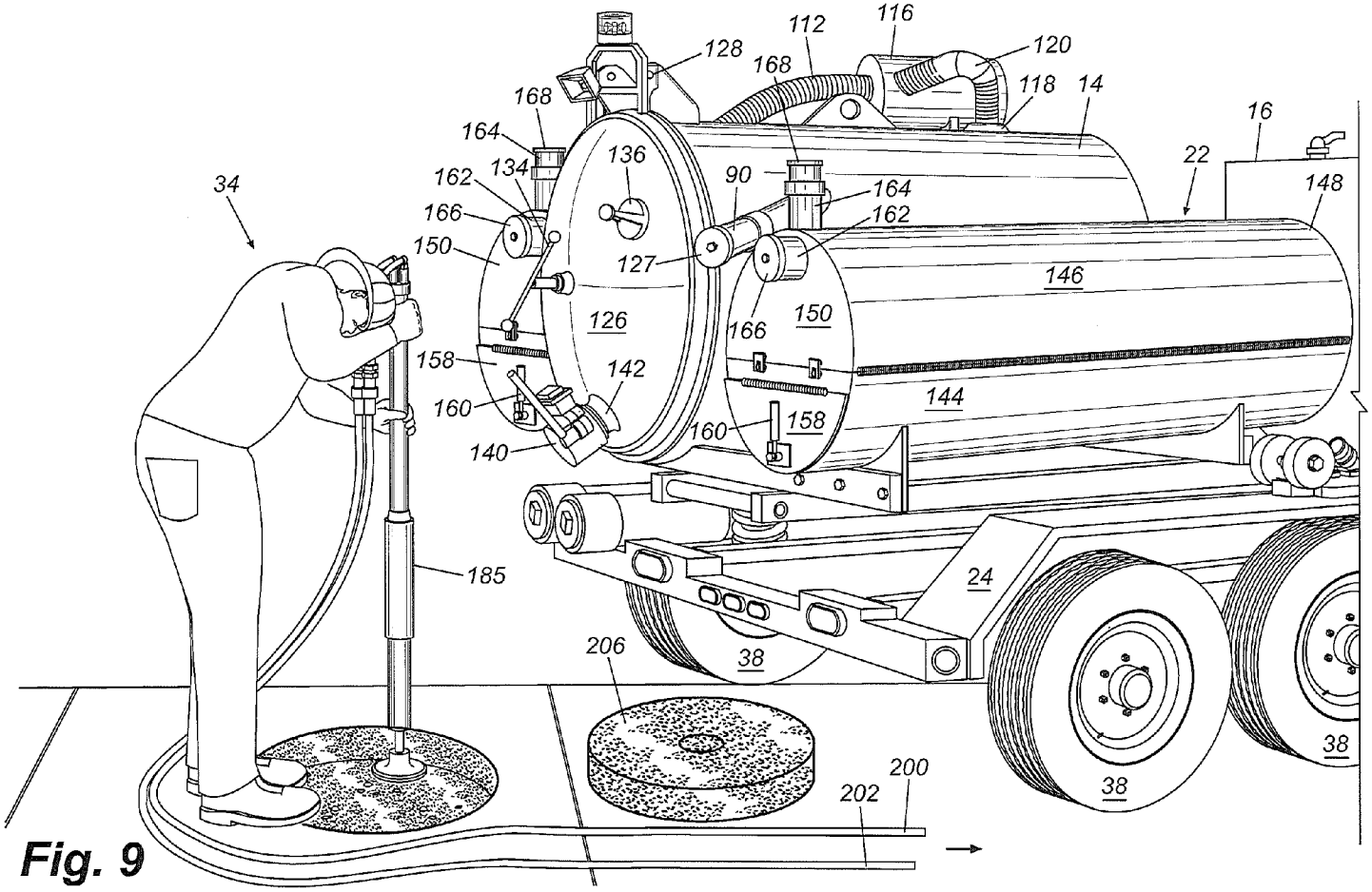
FIG. 9 is a perspective view of the drilling and backfill system of FIG. 1, showing the hole being tamped.

With reference to FIG. 9, operator 34 may use a tamping device 185 to tamp the backfill in the hole. Tamping device 185 connects to hydraulic pump 172 through quick disconnect couplings 182 and 184 via hydraulic lines 200 and 202. Tamping device 185 is used to pack the backfill in the hole and to remove any air pockets. Once the hole has been filed and properly packed, coupon 206 is moved into the remaining portion of the hole. The reuse of coupon 206 eliminates the need to cover the hole with new concrete. Instead, coupon 206 is placed in the hole, and grout is used to seal any cracks between the key and the surrounding concrete. Thus, the overall cost and time of repairing the concrete is significantly reduced, and the need for new concrete is effectively eliminated.

Drilling and backfill system 10 can be used to dig multiple holes before having to empty collection tank 14. However, once collection tank 14 is full, it can be emptied at an appropriate dump site. In emptying collection tank 14, motor 16 is idled to maintain a vacuum in tank 14. This allows the door handle to be turned so that the female threaded member (not shown) is no longer in threading engagement with the male member (not shown) on nozzle rod 132, while the vacuum pressure continuing to hold the door closed. Once motor 16 is shut down, the vacuum pressure is released so that air enters the tank, thereby pressurizing the tank and allowing the door to be opened. Once opened, hydraulic cylinders 130 can be activated to raise forward end 132 upward dumping the slurry from the tank.

Collection tank 14 may also include a vacuum switch and relay (not shown) that prevents the tank from being raised for dumping until the vacuum in the tank has dropped below a predetermined level for door 126 to be opened. Once the vacuum in the tank has diminished to below the predetermined level, tank 14 may be elevated for dumping. This prevents slurry from being pushed up into filter 116 if door 126 can not open.

It should be appreciated by those skilled in the art that various modifications and variations can be made in the present invention without departing from the scope and spirit of the invention. It is intended that the present invention cover such modifications and variations as come within the scope and spirit of the appended claims and their equivalents.

What is claimed is:

1. A mobile digging and backfill system for removing and collecting material from a location, comprising:

a mobile chassis having a front end, an opposite back end, a first side, an opposite second side, and a plurality of wheels attached to the first side and the second side;

a collection tank mounted to the chassis and defining an interior thereof;

a tool defining an interior passage therethrough having an opening at an end thereof in fluid communication with the interior passage;

a hose in fluid communication with the interior passage and the interior of the collection tank;

a vacuum pump having an inlet in fluid communication with the interior of the collection tank so that operation of the vacuum pump draws an air stream through the opening, the interior passage, the hose, and into the interior of the collection tank;

a backfill reservoir having a first end and a second end opposite the first end, and defining an interior thereof, wherein the backfill reservoir is disposed on the chassis so that the first end is disposed at the back end of the chassis, a first door is disposed pivotally on the first end at an opening through the first end to the interior of the backfill reservoir, the backfill reservoir is disposed movably on the chassis between a first position of the second end with respect to the first end and a second position of the second end with respect to the first end, the second end is higher, with respect to the first end, in the second position than in the first position, a first door is disposed pivotally on the first end at an opening through the first end to the interior of the backfill reservoir so that, in the second position of the backfill reservoir, opening of the first door allows flow of material from the interior of the backfill reservoir through the opening through the first end, a latch between the first door and a body of the backfill reservoir that is actuatable to secure the first door in a position that closes the opening through the first end, and the backfill reservoir has a second door that defines an upper surface of the backfill reservoir and that is pivotal between a closed position that blocks access to the interior of the backfill reservoir from an area above the backfill reservoir and an open position in which the interior of the backfill reservoir is accessible from the area.

2. A method of digging and backfilling a location, comprising the steps of:

providing a mobile digging and backfill system for removing and collecting material from a location, comprising:

a mobile chassis having a front end, an opposite back end, a first side, an opposite second side, and a plurality of wheels attached to the first side and the second side, a collection tank mounted to the chassis and defining an interior thereof, a tool defining an interior passage therethrough having an opening at an end thereof in fluid communication with the interior passage, a hose in fluid communication with the interior passage and the interior of the collection tank, a vacuum pump having an inlet in fluid communication with the interior of the collection tank so that operation of the vacuum pump draws an air stream through the opening, the interior passage, the hose, and into the interior of the collection tank, a backfill reservoir having a first end and a second end opposite the first end, and defining an interior thereof, wherein the backfill reservoir is disposed on the chassis so that the first end is disposed at the back end of the chassis, a first door is disposed pivotally on the first end at an opening through the first end to the interior of the backfill reservoir, the backfill reservoir is disposed movably on the chassis between a first position of the second end with respect to the first end and a second position of the second end with respect to the first end, the second end is higher, with respect to the first end, in the second position than in the first position, a first door is disposed pivotally on the first end at an opening through the first end to the interior of the backfill reservoir so that, in the second position of the backfill reservoir, opening of the first door allows flow of material from the interior of the backfill reservoir through the opening through the first end, a latch between the first door and a body of the backfill reservoir that is actuatable to secure the first door in a position that closes the opening through the first end, and the backfill reservoir has a second door that defines an upper surface of the backfill reservoir and that is pivotal between a closed position that blocks access to the interior of the backfill reservoir from an area above the backfill reservoir and an open position in which the interior of the backfill reservoir is accessible from the area;

actuating the vacuum pump;

placing the opening at the end of the tool proximate the location so that material from the location is drawn by the air stream into the interior of the collection tank;

opening the second door and disposing material into the interior of the backfill reservoir;

disposing the chassis so that the first end of the backfill reservoir is proximate the location; and following the placing step, opening the first door and moving the backfill reservoir to the second position so that the material disposed into the interior of the backfill reservoir flows out of the interior of the backfill reservoir through the opening in the first end to the location.

* * * * *